US005891319A

United States Patent [19]

Freire et al.

[11] Patent Number: 5,891,319

[45] **Date of Patent: *Apr. 6, 1999**

[54] METHOD FOR AND APPARATUS PRODUCTION OF CARBONYL HALIDE

[75] Inventors: Francisco Jose Freire; Kenneth Bernard Keating, both of Wilmington; Edward Kaoru Sakata, Newark, all of Del.

[73] Assignee: E. I. du Pont de Nemours and Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 771,496

[22] Filed: Dec. 23, 1996

Related U.S. Application Data

[60] Provisional application No. 60/009,518, Dec. 28, 1995.

[51] Int. Cl. [6] ..... C25B 1/24; C25B 9/00

[52] U.S. Cl. ..... 205/499; 204/263; 204/237; 204/265; 204/266; 205/637

[58] Field of Search ..... 204/263–266, 204/237; 205/499, 637

[56] References Cited

U.S. PATENT DOCUMENTS

| | | | |
|---|---|---|---|
| 4,834,847 | 5/1989 | McIntyre | 204/263 |
| 5,411,641 | 5/1995 | Trainham, III et al. | 205/618 |
| 5,595,641 | 1/1997 | Traini et al. | 204/263 X |

FOREIGN PATENT DOCUMENTS

| | | | |
|---|---|---|---|
| 54-1281 | 1/1979 | Japan . | |
| 7-216570 | 8/1995 | Japan | C25B 1/26 |
| WO 95/14797 | 6/1995 | WIPO . | |
| WO 97/19205 | 5/1997 | WIPO . | |

OTHER PUBLICATIONS

Kirk–Othmer, *Encyclopedia of Chemical Technology,* vol. 17, "Peroxides and Peroxy Compounds, Inorganic to Piping Systems", Third Edition, John Wiley & Sons (1982), pp. 416–425 No Month.

Minz, F.R. "HCI–Electrolysis—Technology for Recycling Chlorine", Bayer AG, Conference on Electrochemical Processing, Innovation & Progress, Glasgow, Scotland, UK, Apr. 21–23, 1993.

Eames, D.J. et al., "Electrochemical Conversion of Anhydrous HCI to $CL_2$ Using a Solid–Polymer–Electrolyte Electrolysis Cell", *Interface,* vol. 3., No. 1, Abstracts, Douglas N. Bennion Memorial Symposium, The Electrochemical Society, Spring, 1994 No Month.

(List continued on next page.)

*Primary Examiner*—Donald R. Valentine

[57] ABSTRACT

Carbonyl halide is produced from carbon monoxide and halogen produced from the electrochemical conversion of anhydrous hydrogen halide. Both the oxidation of anhydrous hydrogen halide and the formation of carbonyl halide are carried out in the anode-compartment of an electrochemical cell. This reduces the equipment and thus the capital investment necessary for carrying out these reactions. Moreover, no catalyst is needed to form halogen and subsequently make carbonyl halide, as in the prior art. In addition, the health hazards associated with making a carbonyl halide, such as phosgene, at high temperatures from chlorinated hydrocarbons with atmospheric oxygen are virtually eliminated. Furthermore, the halogen produced as a result of the oxidation of anhydrous hydrogen halide are dry, thereby eliminating the need for a preheater before the halogen is reacted with carbon monoxide. Thus, with the present invention, carbonyl halide may be produced more easily, more safely and more inexpensively as compared to prior art processes.

20 Claims, 2 Drawing Sheets

OTHER PUBLICATIONS

Eames, D.J. et al., "Electrochemical Conversion of Anhydrous HCI to $CL_2$ Using a Solid–Polymer–Electrolyte Electrolysis Cell", Presentation at the Douglas N. Bennion Memorial Symposium, 185$^{th}$ Meeting, The Electrochemical Society, Inc., San Francisco, CA, May 25, 1994.

Eames, D.J., "Production of Chlorine from Anhydrous Hydrogen Chloride in a Solid–Polymer–Electrolyte Cell", Thesis, University of California, Berkeley, catalogued Dec. 13, 1994, pp. 1–93.

Eames, D.J. et al., "Electrochemical Conversion of Anhydrous HCI to $CL_2$ Using a Solid–Polymer–Electrolyte Electrolysis Cell", Jan. 16, 1995, pp. 322–336.

Schneiders, K., et al. "Recycle of HCI to Chlorine", *Chlorine Institute,* Houston, Texas, May, 1995, pp. 1–26.

Villwock, R.D., et al., "Recovery of Chlorine from Waste Anhydrous Hydrogen Chloride in a Membrane Electrolysis Cell", Presentation at 187th Electrochemical Society Meeting, Reno, Nevada, May 22, 1995.

Tatapudi, P., et al., "Electrochemical Conversion of Anhydrous Hydrogen Chloride to Chlorine in a Proton Exchange Membrane Reactor", Los Alamos National Laboratory, Los Alamos, New Mexico, Presentation at 187$^{th}$ Electrochemical Society Meeting, Reno, Nevada, May 21–26, 1995; published in the Proceedings on the Symposium on *Water Purification by Photocatalytic, Photoelectrochemical and Electrochemical Processes,* vol. 95, No. 12 (1995) No Month.

Eames, D.J. et al., "Electrochemical Conversion of Anhydrous HCI to $CL_2$ Using a Solid Polymer Electrolyte Electrolysis Cell", *J. Electrochem. Soc.,* vol. 42, No. 11, (Nov. 1995), pp. 3619–3625.

Ullmann's Encyclopedia of Industrial Chemistry, vol. A19, "Parkinsonism Treatment of Photoelectricity", VCH Verlagsgesellschaft, Fifth Edition, (1991), pp. 411–420 (No Month).

FIG.2
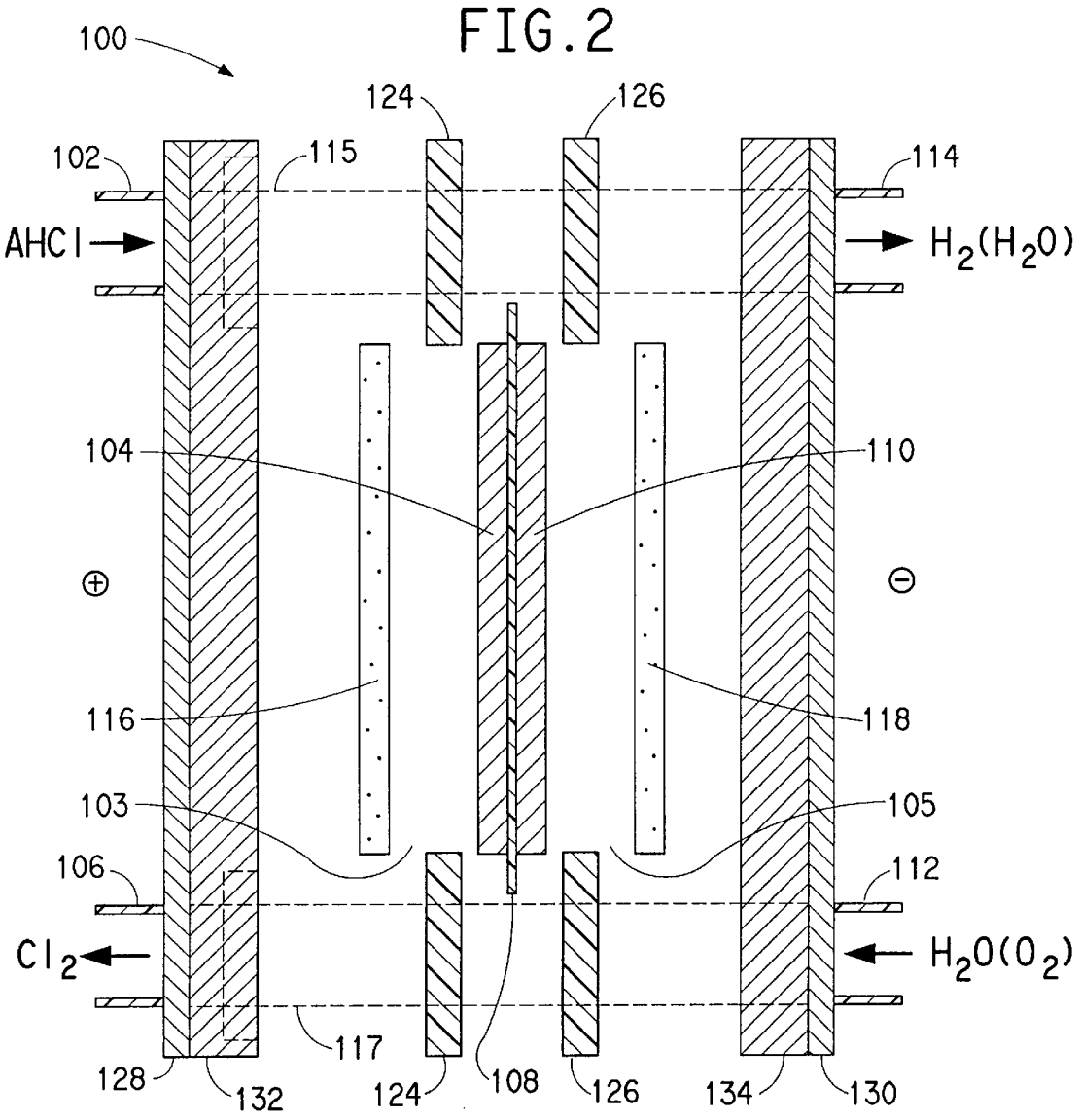
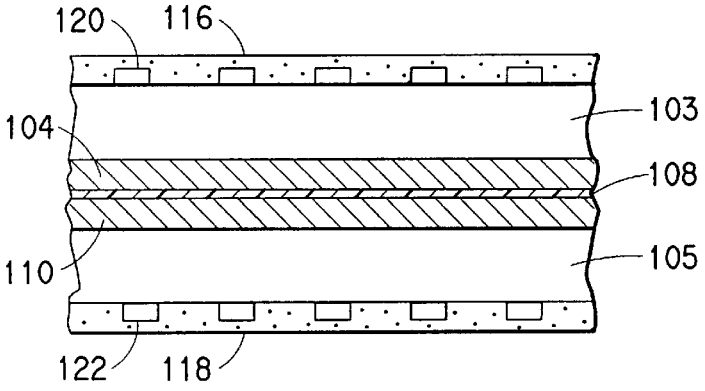
FIG.2A

METHOD FOR AND APPARATUS PRODUCTION OF CARBONYL HALIDE

This application claims the priority benefit of U.S. Provisional application Ser. No. 60/009,518, filed Dec. 28, 1995.

BACKGROUND OF THE INVENTION

1. Field of the Invention

The present invention relates to an electrochemical cell, a system and a process for producing carbonyl halide from halogen produced by the electrochemical conversion of anhydrous hydrogen halide. In this conversion, essentially anhydrous hydrogen halide, which is molecular in form, is oxidized to produce protons and halogen. The halogen reacts with carbon monoxide to produce a carbonyl halide, such as carbonyl chloride (phosgene) or carbonyl fluoride.

2. Description of the Related Art

Phosgene is currently commercially produced by passing carbon monoxide and chlorine over activated carbon in a phosgene generator. This reaction must be carried out in the presence of a catalyst. The chlorine is usually produced from conventional chloralkali electrolysis or HCl electrolysis, which produce wet chlorine gas, or from evaporators in which liquid chlorine is evaporated. Usually, chlorine is fed through a preheater before mixing with carbon monoxide in the phosgene generator in order to avoid introducing liquid chlorine into the phosgene generator. Thus, the production of phosgene from a catalyst involves a multi-step process carried out in multiple pieces of equipment, which contributes to the capital investment and operating costs associated with producing phosgene. In addition, phosgene can be formed at high temperatures from chlorinated hydrocarbons with atmospheric oxygen. However, this reaction can lead to possible health hazards. See *Ullmann's Encyclopedia of Industrial Chemistry*, Fifth Edition, Volume A 19, pages 411–419.

Phosgene is an important starting compound in the production of intermediates and end products in many branches of large-scale industrial chemistry. For instance, it is used widely in the preparation of isocyanates, which are in turn used in the preparation of polyurethanes and in the manufacture of polycarbonates. It is also used in the synthesis of pharmaceuticals and pesticides.

In addition, phosgene, together with either sodium fluoride or hydrogen fluoride, can be used to make carbonyl fluoride. Carbonyl fluoride is a specialty fluorinating agent. It is used to make vinyl ethers and is an intermediate for other fluoroproducts. It is not used in large quantities because it is expensive to make.

Hydrogen chloride (HCl) or hydrochloric acid is a reaction by-product of many manufacturing processes which use chlorine. For example, chlorine is used to manufacture polyvinyl chloride, isocyanates, and chlorinated hydrocarbons/fluorinated hydrocarbons, with hydrogen chloride as a by-product of these processes. Because supply so exceeds demand, hydrogen chloride or hydrochloric acid often cannot be sold or used, even after careful purification. Shipment over long distances is not economically feasible. Discharge of the chloride ions or the acid into waste water streams is environmentally unsound. Recovery of the chlorine for use in a manufacturing process is the most desirable route for handling the HCl by-product.

Therefore, the need exists for developing a simple, inexpensive method for producing carbonyl halide, and in particular, carbonyl chloride or carbonyl fluoride, as well as for disposing hydrochloric acid. It would be desirable to develop equipment and a process which satisfy both needs at the same time.

SUMMARY OF THE INVENTION

The present invention simultaneously satisfies both the need for developing a simple, inexpensive method for producing carbonyl halide, as well as for disposing of hydrochloric acid. The present invention achieves these objectives by providing an electrochemical cell, system and a process which convert anhydrous hydrogen halide, such as HCl, as well as produce carbonyl halide in a single piece of equipment. Furthermore, the halogen, such as chloride anions, produced as a result of the oxidation of anhydrous hydrogen halide are dry, thereby eliminating the need for a preheater before mixing them with carbon monoxide, which is conventionally done in prior art processes, or example, for making phosgene, in order to avoid introducing liquid chlorine into a phosgene generator. Thus, the present invention reduces the capital investment and the operating costs associated with producing carbonyl halide by reducing the amount of equipment and the number of steps associated with this production.

In addition, the electrochemical cell, system and the process of the present invention eliminate the need for a catalyst in the production of carbonyl halide, thereby also reducing the capital investment and operating costs associated with this process.

Moreover, the electrochemical cell, system and the process of the present invention avoid the health hazards associated with production of, for instance, phosgene from chlorinated hydrocarbons with atmospheric oxygen at high temperatures. This represents an advance in the safety of processes for carbonyl halides, such as phosgene.

To achieve the foregoing solutions, and in accordance with the purposes of the invention as embodied and broadly described herein, there is provided an electrochemical cell for producing carbonyl halide. The cell comprises inlet means for introducing anhydrous hydrogen halide and carbon monoxide to an anode compartment; means for oxidizing the anhydrous hydrogen halide to produce halogen and protons, wherein the halogen and the carbon monoxide react in the anode compartment to form carbonyl halide; outlet means for releasing the carbonyl halide from the anode compartment; cation-transporting means for transporting the protons therethrough, wherein the oxidizing means is disposed in contact with one side of the cation-transporting means; and means for reducing the transported protons, wherein the reducing means is disposed in contact with the other side of the cation-transporting means.

A portion of the anhydrous hydrogen halide and a portion of the carbon monoxide may be unreacted and may exit the anode compartment of the cell through the outlet means, along with the carbonyl halide. An anode-side separator may be provided in a system according to the present invention which includes an electrochemical cell as described above, which separator separates the unreacted portion of the essentially anhydrous hydrogen halide and the carbon monoxide from the carbonyl halide. A recycle line may be provided in the system according to the present invention for recycling this separated, unreacted hydrogen halide and carbon monoxide to the inlet means of the cell.

Further in accordance with the present invention, there is provided a process for producing carbonyl halide. The process includes the steps of supplying carbon monoxide and anhydrous hydrogen halide to an anode-side inlet of an electrochemical cell, wherein the electrochemical cell also comprises a cation-transporting membrane, an anode disposed in contact with one side of the membrane and a cathode disposed in contact with the other side of the membrane, wherein the carbon monoxide is supplied in stoichiometric excess of the anhydrous hydrogen halide, and applying a voltage to the electrochemical cell so that the anode is at a higher potential than the cathode, and so that the anhydrous hydrogen halide is oxidized at the anode to produce halogen and protons, the halogen reacts with the carbon monoxide to form carbonyl halide, the carbonyl halide is released from an anode-side outlet of the cell, the protons are transported through the cation-transporting membrane of the cell, and the transported protons are reduced at the cathode of the cell. The carbonyl halide may be in particular either carbonyl chloride or carbonyl fluoride.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIG. 2 is a schematic diagram showing the details of an electrochemical cell for producing carbonyl halide used in the system of FIG. 1, illustrating initial operation of the electrochemical cell, before any recycling has occurred.

FIG. 2A is a cut-away, top cross-sectional view of the anode and cathode mass flow fields as shown in FIG. 2.

DESCRIPTION OF THE PREFERRED EMBODIMENTS

Figure 1:
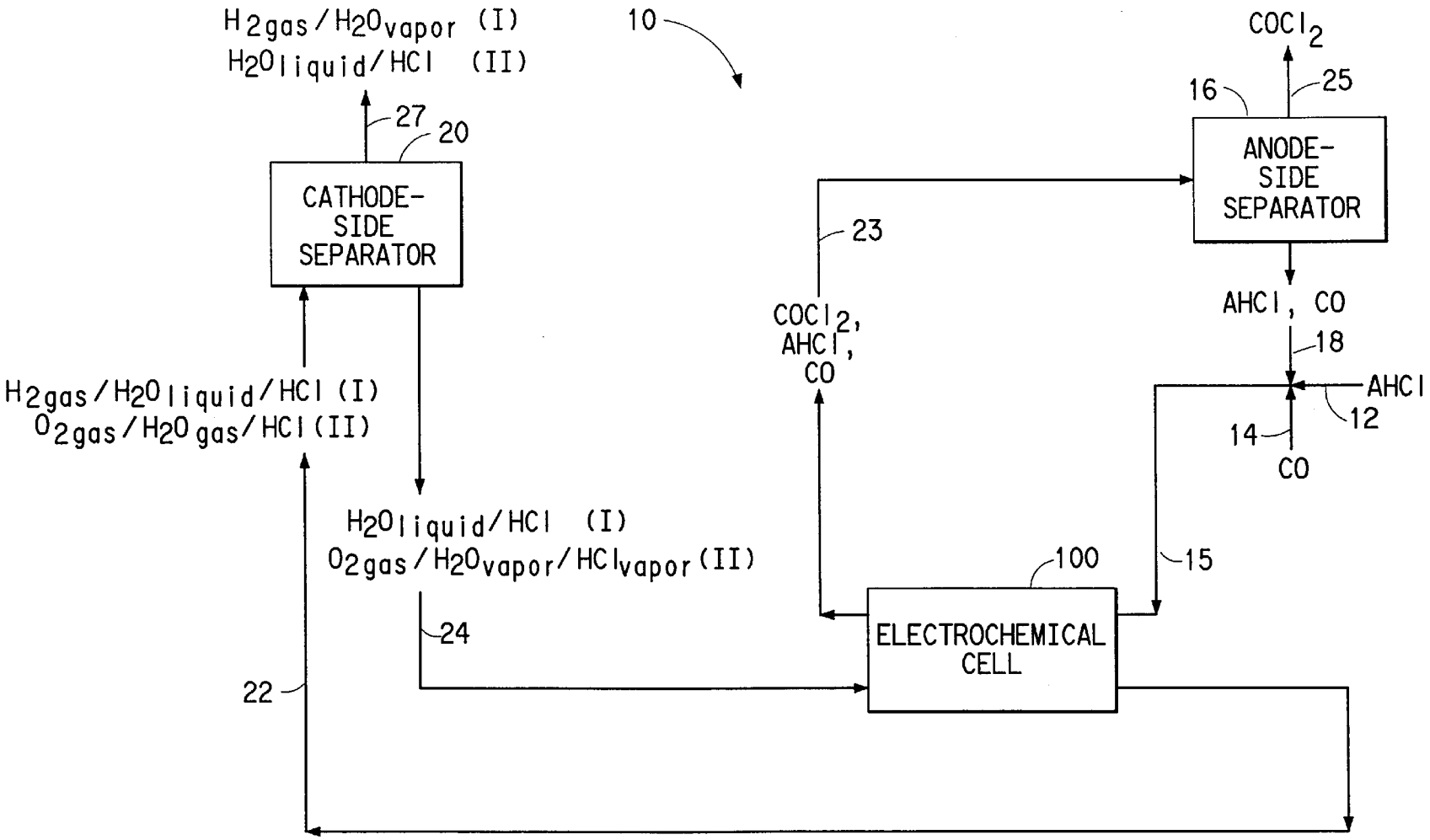
FIG. 1 is a schematic diagram of a system according to the present invention for producing carbonyl halide, illustrating continuous operation of the system, during which recycling of the products of the cell occurs.

Reference will now be made in detail to the present preferred embodiments of the invention as illustrated in the accompanying drawings.

In accordance with the present invention, there is provided a system for producing carbonyl halide from halogen produced by the electrochemical conversion of anhydrous hydrogen halide. The system of the present invention is shown generally at 10 in FIG. 1. This electrochemical conversion directly converts essentially anhydrous hydrogen halide to dry halogen gas. The term "direct" means that the electrochemical cell obviates the need to convert the essentially anhydrous hydrogen halide, such as where anhydrous hydrogen chloride is converted to aqueous hydrogen chloride, before electrochemical treatment. By "anhydrous", or "essentially anhydrous", is meant that the hydrogen halide is molecular in form, as opposed to hydrogen halide which is ionic in form.

The system of the present invention includes an electrochemical cell which is shown generally at 100 in FIGS. 1 and 2, with the particular details of the cell being shown in FIG. 2. It should be noted that FIG. 2 shows only the initial reactants and products in the electrochemical cell, and not those reactants and products which are present due to the continuous operation of the system as shown in FIG. 1, which operation will be explained below. The electrochemical cell as shown in FIGS. 1 and 2 will be described with respect to an illustrated case of the present invention, which directly produces carbonyl chloride, or phosgene, from essentially anhydrous hydrogen chloride. However, it should be noted that it is within the scope of the present invention to use this cell alternatively to produce other carbonyl halides, including, but not limited to, carbonyl fluoride from anhydrous hydrogen fluoride.

The electrochemical cell of the present invention comprises inlet means for introducing anhydrous hydrogen halide and carbon monoxide to an anode compartment. The inlet means comprises an anode-side inlet 102 as shown in FIG. 2, and the anode compartment is shown at 103 in FIGS. 2 and 2A. Anhydrous hydrogen chloride, which is a gas, is designated by AHCl in FIGS. 1 and 2, and carbon monoxide, which is also a gas, is designated by CO in FIG. 1. Molecules of essentially anhydrous hydrogen halide and carbon monoxide are introduced through inlet 102 and into anode compartment 103.

The system of the present invention further includes a hydrogen halide supply line connected to the inlet means of the electrochemical cell for supplying the anhydrous hydrogen halide to the cell. A hydrogen halide supply line, shown at 12 in FIG. 1, supplies anhydrous hydrogen halide, such as hydrogen chloride, to anode-side inlet 102 and then to anode compartment 103. This line supplies an "initial" supply of essentially anhydrous hydrogen halide. By "initial" is meant a supply before the cell first begins operating. Hydrogen halide supply line 12 also supplies a fresh supply of hydrogen halide during operation, as will be explained more fully below.

The system of the present invention further includes a carbon monoxide supply line connected to the inlet means for supplying carbon monoxide to the cell. This carbon monoxide supply line is shown at 14 in FIG. 1 and supplies carbon monoxide to anode-side inlet 102 and then to anode compartment 103. This line supplies an initial supply of carbon monoxide (i.e., before the cell first begins operating), as well as a fresh supply of carbon monoxide during operation, as will also be explained more fully below. The carbon monoxide is fed in stoichiometric excess of the hydrogen halide, such as carbonyl chloride, so as to keep the free halogen content of the carbonyl halide as low as possible. This is done since the presence of halogens, such as chlorine, can lead to the formation of undesirable products during further processing of the carbonyl halide. The hydrogen halide supply line and the carbon monoxide supply line combine at a location near the electrochemical cell into a line 15 as shown in FIG. 1. Line 15 is connected to the anode-side inlet of the electrochemical cell.

The electrochemical cell of the present invention also includes means for oxidizing the anhydrous hydrogen halide to produce halogen and protons. The oxidizing means comprises an electrode, or more specifically, an anode 104 as shown in FIGS. 2 and 2A. The oxidizing means oxidizes the anhydrous hydrogen halide, which is molecular in form, to produce nascent halogen which is essentially dry, and protons. This reaction for anhydrous hydrogen chloride is given by the equation:

$$2HCl\ (g) \xrightarrow[\text{Energy}]{\text{Electrical}} 2H^+ + Cl_2^- + 2e^- \quad (1)$$

The halogen and the carbon monoxide react in the anode compartment to form carbonyl halide. In the illustrated case, the chlorine react with the carbon monoxide in the anode compartment of the cell to form carbonyl chloride, or phosgene. This reaction is given by the equation:

$$Cl_2^- + CO \xrightarrow{\text{Electrical Energy}} COCl_2 \quad (2)$$

It should be noted that when the molecules of essentially anhydrous hydrogen halide are oxidized, a portion of this anhydrous hydrogen halide may be unreacted. In addition, when the halogen react with the carbon monoxide to produce carbonyl halide, a portion of the carbon monoxide may be unreacted.

The electrochemical cell of the present invention also includes outlet means for releasing the carbonyl halide, along with the unreacted carbon monoxide and the unreacted anhydrous hydrogen halide, from the anode compartment of the electrochemical cell. The outlet means comprises an anode-side outlet 106 as shown in FIG. 2. The anode-side inlet and the anode-side outlet are both disposed in fluid communication with the anode compartment. The unreacted portions of the anhydrous hydrogen halide (AHCl) and the carbon monoxide (CO), respectively, exit the cell through anode-side outlet 106, along with the carbonyl halide ($COCl_2$), through a line 23 as shown in FIG. 1. Since in the illustrated case, anhydrous HCl is carried through the anode-side inlet, and chlorine gas is carried through the outlet, the inlet and the outlet may be lined with a copolymer of tetrafluoroethylene with perfluoro(alkylvinyl ether), sold under the trademark TEFLON® PFA (hereinafter referred to as "PFA") by E. I. du Pont de Nemours and Company of Wilmington, Del. (hereinafter referred to as "DuPont").

The electrochemical cell of the present invention also comprises cation-transporting means for transporting the protons therethrough, wherein the oxidizing means is disposed in contact with one side of the cation-transporting means. Preferably, the cation-transporting means is a cation-transporting membrane 108, where the anode is disposed in contact with one side of the membrane as shown in FIGS. 2 and 2A. More specifically, membrane 108 may be a proton-conducting membrane. In the present invention, the membrane acts as the electrolyte. The membrane may be a commercial cationic membrane made of a fluoro- or perfluoropolymer, preferably a copolymer of two or more fluoro or perfluoromonomers, at least one of which has pendant sulfonic acid groups. The presence of carboxylic groups is not desirable, because those groups tend to decrease the conductivity of the membrane when they are protonated. Various suitable resin materials are available commercially or can be made according to the patent literature. They include fluorinated polymers with side chains of the type $—CF_2CFRS0_3H$ and $—OCF_2CF_2CF_2SO_3H$, where R is an F, Cl, $CF_2Cl$, or a $C_1$ to $C_{10}$ perfluoroalkyl radical. The membrane resin may be, for example, a copolymer of tetrafluoroethylene with $CF_2=CFOCF_2CF(CF_3)OCF_2CF_2SO_3H$. Sometimes those resins may be in the form that has pendant $—SO_2F$ groups, rather than $—SO_3H$ groups. The sulfonyl fluoride groups can be hydrolyzed with potassium hydroxide to $—SO_3K$ groups, which then are exchanged with an acid to $—SO_3H$ groups. Suitable perfluorinated cationic membranes, which are made of hydrated copolymers of tetrafluoroethylene and perfluoro vinyl ether containing pendant sulfonic acid groups, are offered DuPont under the trademark "NAFION®" (hereinafter referred to as NAFION®). In particular, NAFION® membranes containing pendant sulfonic acid groups include NAFION® 115, NAFION® 117, NAFION® 324 and NAFION® 417. The first and second types of NAFION® are unsupported and have an equivalent weight of 1100 g., equivalent weight being defined as the amount of resin required to neutralize one liter of a 1M sodium hydroxide solution. NAFION® 324 and NAFION® 417 are both supported on a fluorocarbon fabric, the equivalent weight of NAFION® 417 also being 1100 g. NAFION® 324 has a two-layer structure, a 125 $\mu$m-thick membrane having an equivalent weight of 1100 g., and a 25 $\mu$m-thick membrane having an equivalent weight of 1500 g. NAFION® 115 in particular may be used with the electrochemical cell of the present invention.

Although the present invention describes the use of a solid polymer electrolyte membrane, it is well within the scope of the invention to use other cation-transporting membranes which are not polymeric. For example, proton-conducting ceramics such as beta-alumina may be used. Beta-alumina is a class of nonstoichiometric crystalline compounds having the general structure $Na_2O_x.Al_2O_3$, in which x ranges from 5 00(β"-alumina) to 11 (β-alumina). This material and a number of solid electrolytes which are useful for the invention are described in the *Fuel Cell Handbook*, A. J. Appleby and F. R. Foulkes, Van Nostrand Reinhold, N.Y., 1989, pages 308–312. Additional useful solid state proton conductors, especially the cerates of strontium and barium, such as strontium ytterbiate cerate ($SrCe_{0.95}Yb_{0.05}O_{3-\alpha}$) and barium neodymiate cerate ($BaCe_{0.09}Nd_{0.01}O_{3-\alpha}$) are described in a final report, DOE/MC/24218-2957, Jewulski, Osif and Remick, prepared for the U.S. Department of Energy, Office of Fossil Energy, Morgantown Energy Technology Center by Institute of Gas Technology, Chicago, Ill., December, 1990.

The electrochemical cell of the present invention also comprises means for reducing the transported protons, where the reducing means is disposed in contact with the other side of the cation-transporting means. The reducing means comprises an electrode, or more specifically, a cathode 110, where cathode 110 is disposed in contact with the other side (as opposed to the side which is in contact with the anode) of membrane 108 as illustrated in FIGS. 2 and 2A. A cathode compartment 105 as shown in FIGS. 2 and 2A is disposed on the other side of the cathode (as opposed to the side which is in contact with the membrane). Electrochemical cell 100 also has a cathode-side inlet 112 and a cathode-side outlet 114 as shown in FIG. 2. The cathode-side inlet and the cathode-side outlet are both disposed in fluid communication with the cathode compartment. Since in the illustrated case where anhydrous HCl is processed some chloride ions pass through the membrane and, consequently, HCl is present on the cathode-side of the cell, the cathode-side inlet and the outlet may also be lined with PFA. A passage 115 as shown in FIG. 2 is formed between anode-side inlet 102 and cathode-side outlet 114, and a similar passage 117 is shown formed between cathode-side inlet 112 and anode-side outlet 106. These passages carry the reactants into and the products out of the cell through the anode and cathode-side inlets, and the anode and cathode-side outlets, as will be further explained below.

The anode and the cathode comprise an electrochemically active material. The electrochemically active material may comprise any type of catalytic or metallic material or metallic oxide, as long as the material can support charge transfer. Preferably, the electrochemically active material may comprise a catalyst material such as platinum, ruthenium, osmium, rhenium, rhodium, iridium, palladium, gold, titanium, tin or zirconium and the oxides, alloys or mixtures thereof. Other catalyst materials suitable for use with the present invention may include, but are not limited to, transition metal macro cycles in monomeric and polymeric forms and transition metal oxides, including perovskites and pyrochores.

The anode and the cathode may be porous, gas-diffusion electrodes. Gas diffusion electrodes provide the advantage of high specific surface area, as known to one skilled in the art. A particular type of gas diffusion electrode, known as an ELAT, may be used as the anode and the cathode. An ELAT comprises a support structure, as well as the electrochemically active material. In one preferred embodiment, an ELAT comprising a support structure of carbon cloth and electrochemically active material comprising ruthenium oxide, commercially available from E-TEK, of Natick, Massachusetts, may be used. Alternatively, an ELAT may be used which comprises a catalyst material mixed with carbon and particles of polytetrafluoroethylene, or PTFE, a fluoropolymer resin which is sold under the trademark "TEFLON®" (hereinafter referred to as "PTFE"), commercially available from DuPont. The catalyst material, carbon particles and PTFE are then sintered on a carbon cloth substrate, which is treated with a NAFION® solution. This ELAT is held mechanically against the membrane of the cell.

Alternative arrangements of the electrochemically active material may be used for the anode and cathode of the present invention. The electrochemically active material may be disposed adjacent, meaning at or under, the surface of the cation-transporting membrane. For instance, the electrochemically active material may be deposited into the membrane, as shown in U.S. Pat. No. 4,959,132 to Fedkiw. A thin film of the electrochemically active material may be applied directly to the membrane. Alternatively, the electrochemically active material may be hot-pressed to the membrane, as shown in A. J. Appleby and E. B. Yeager, Energy, Vol. 11, 137 (1986).

If the electrodes are hot-pressed into the membrane, they have the advantage of having good contact between the catalyst and the membrane. In a hot-pressed electrode, the electrochemically active material may comprise a catalyst material on a support material. The support material may comprise particles of carbon and particles of PTFE. The electrochemically active material may be bonded by virtue of the PTFE to a support structure of carbon cloth or paper or graphite paper and hot-pressed to the cation-transporting membrane. The hydrophobic nature of PTFE does not allow a film of water to form at the anode. A water barrier in the electrode would hamper the diffusion of HCl to the reaction sites.

The loadings of electrochemically active material may vary based on the method of application to the membrane. Hot-pressed, gas-diffusion electrodes typically have loadings of 0.10 to 0.50 mg/cm$^2$. Lower loadings are possible with other available methods of deposition, such as distributing them as thin films from inks onto the membranes, to form a catalyst-coated membrane, as described in Wilson and Gottesfeld, "High Performance Catalyzed Membranes of Ultra-low Pt Loadings for Polymer Electrolyte Fuel Cells", Los Alamos National Laboratory, J. Electrochem. Soc., Vol. 139, No. 2 L28–30, 1992, where the inks contain solubilized NAFION® to enhance the catalyst-ionomer surface contact and to act as a binder to the NAFION® perfluorinated membrane sheet. With such a system, loadings as low as 0.017 mg active material per cm$^2$ have been achieved.

In a preferred embodiment, a thin film of the electrochemically active material is be applied directly to the membrane to form a catalyst-coated membrane. In this preferred embodiment, the membrane is typically formed from a polymer as described above in its sulfonyl fluoride form, since it is thermoplastic in this form, and conventional techniques for making films from thermoplastic polymer can be used. The sulfonyl fluoride, or $SO_2F$, form means that the side chain, before the membrane is hydrolyzed, has the formula $[—OCF_2CF(CF_3)]n—OCF_2CF_2SO_2F$. Alternately, the polymer may be in another thermoplastic form such as by having $—SO_2X$ groups where X is $CH_3$, $CO_2$, or a quaternary amine. Solution film casting techniques using suitable solvents for the particular polymer can also be used if desired.

A film of the polymer in sulfonyl fluoride form can be converted to the sulfonate form (sometimes referred to as ionic form) by hydrolysis using methods known in the art. For example, the membrane may be hydrolyzed to convert it to the sodium sulfonate form by immersing it in 25% by weight NaOH for about 16 hours at a temperature of about 90° C. followed by rinsing the film twice in deionized 90° C. water using about 30 to about 60 minutes per rinse. Another possible method employs an aqueous solution of 6–20% of an alkali metal hydroxide and 5–40% polar organic solvent such as dimethyl sulfoxide with a contact time of at least 5 minutes at 50–100° C. followed by rinsing for 10 minutes. After hydrolyzing, the membrane can be converted if desired to another ionic form by contacting the membrane in a bath containing a 1% salt solution containing the desired cation or, to the acid form, by contacting with an acid and rinsing. The membrane used in the membrane-electrode assembly of the present invention is usually in the sulfonic acid form.

The thickness of the membrane can be varied as desired. Typically, the thickness of the membrane is generally less than about 250 $\mu$m, preferably in the range of about 25 $\mu$m to about 150 $\mu$m.

The electrochemically active material is conventionally incorporated in a coating formulation, or "ink", which is applied to the membrane. The electrochemically active material in the form of particles having a particle diameter in the range of 0.1 micron ($\mu$) to 10$\mu$. The coating formulation, and consequently the anode and the cathode after the catalyst-coated membrane is formed, also comprises a binder polymer for binding the particles of the electrochemically active material together. The particles of electrochemically active material, when coated with the binder polymer, have a tendency to agglomerate. By grinding the particles to a particularly small size, a better particle distribution may be obtained. Thus, the coating formulation is ground so that the particles have an average diameter of less than 5$\mu$, and in many cases, preferably less than 2$\mu$. This small particle size is accomplished by ball milling or grinding with an Eiger mini mill, which latter technique can produce particles of 1$\mu$ or less.

The binder polymer is dissolved in a solvent. The binder polymer may be the same polymer as that used for the membrane, as described herein, but it need not be. The binder polymer may be a variety of polymers, such as polytetrafluoroethylene (PTFE). In a preferred embodiment, the binder polymer is a perfluorinated sulfonic acid polymer, and the side chain of the binder polymer, before hydrolysis of the binder polymer, is represented by the formula $[—OCF_2CF(CF_3)]_n—OCF_2CF_2SO_2F$ (i.e., the $SO_2F$, or sulfonyl fluoride form). The side chain, after hydrolysis, is represented by the formula $[—OCF_2CF(CF_3)]_n—OCF_2CF_2SO_3H$ (i.e., the $SO_3H$, sulfonic acid, or acid form). When the binder polymer is in the sulfonyl fluoride form, the solvent can be a variety of solvents, such as FLUORINERT FC-40, commercially available from 3M of St. Paul, Minn., which is a mixture of perfluoro(methyl-di-n-butyl)-amine and perfluoro(tri-n-butylamine). In this embodiment, a copolymer polymerized from tetrafluoroethylene and a vinyl ether which is represented by the formula $CF_2{=}CF—O—CF_2CF(CF_3)—O—CF_2CF_2SO_2F$ has been found to be a suitable binder polymer. In addition, ruthenium dioxide has been found to be a suitable catalyst. The sulfonyl fluoride form has been found to be compatible with FC-40 and to give a uniform coating of the ruthenium dioxide catalyst on the membrane.

The viscosity of the ink can be controlled by (i) selecting particle sizes, (ii) controlling the composition of the particles of electrochemically active material and binder, or (iii) adjusting the solvent content (if present). The particles of electrochemically active material are preferably uniformly dispersed in the polymer to assure that a uniform and controlled depth of the catalyst layer is maintained, preferably at a high volume density with the particles of electrochemically active material being in contact with adjacent particles to form a low resistance conductive path through the catalyst layer. The ratio of the particles of electrochemically active material to the binder polymer may be in the range of about 5:1 to about 8:1, and in particular in the range of about 1:1 to about 5:1. The catalyst layer formed on the membrane should be porous so that it is readily permeable to the gases/liquids which are consumed and produced in cell. The average pore diameter is preferably in the range of 0.01 to 50 $\mu$m, most preferably 0.1 to 30 $\mu$m. The porosity is generally in a range of 10 to 99%, preferably 10 to 60%.

The area of the membrane to be coated with the ink may be the entire area or only a select portion of the surface of the membrane. If desired, the coatings are built up to the thickness desired by repetitive application. Areas upon the surface of the membrane which require no particles of electrochemically active material can be masked, or other means can be taken to prevent the deposition of the particles of electrochemically active material upon such areas. The desired loading of particles of electrochemically active material upon the membrane can be predetermined, and the specific amount of particles of electrochemically active material can be deposited upon the surface of the membrane so that no excess electrochemically active material is applied. In a preferred embodiment, the ink is deposited on the surface of the membrane by spraying. However, it should be noted that the catalyst ink may be deposited upon the surface of the membrane by any suitable technique, including spreading it with a knife or blade, brushing, pouring, metering bars and the like. Alternatively, the electrochemically active material may be applied to the membrane by using a screen printing process, as known in the art. An alternative to printing the electrochemically active material directly onto the membrane is the decal process, also known in the art, where the catalyst ink is coated, painted, sprayed or screen printed onto a substrate and the solvent is removed. The resulting decal is then subsequently transferred from the substrate to the membrane surface and bonded, typically by the application of heat and pressure.

After depositing the catalyst layer of electrochemically active material, it is preferable to fix the ink on the surface of the membrane so that a strongly bonded catalyst layer and the cation-transporting membrane can be obtained. The ink may be fixed upon the surface of the membrane by any one or a combination of pressure, heat, adhesive, binder, solvent, electrostatic, and the like. A preferred method for fixing the ink upon the surface of the membrane employs pressure, heat or by a combination of pressure and heat. The catalyst layer is preferably pressed onto the surface of the membrane at 100° C. to 300° C., most preferably 150° C. to 280° C., under a pressure of 510 to 51,000 kPa (5 to 500 ATM), most preferably 1,015 to 10,500 kPa (10 to 100 ATM).

If a catalyst-coated membrane as described above is used, the electrochemical cell must include a gas diffusion layer (not shown) disposed in contact with the anode and the cathode, respectively, (or at least in contact with the anode), on the side of the anode or cathode opposite the side which is in contact with the membrane. The gas diffusion layer provides a porous structure that allows the anhydrous hydrogen halide to diffuse through to the layer of electrochemically active material of the catalyst-coated membrane. In addition, both the anode gas diffusion layer and the cathode gas diffusion layer distribute current over the electrochemically active material, or area, of the catalyst-coated membrane. The diffusion layers are preferably made of graphite paper, and are typically 15–20 mil thick.

When using any type of membrane and electrodes with the present invention, the membrane must be kept hydrated in order to increase the efficiency of proton transport through the membrane. This keeps the conductivity of the membrane high. In the first embodiment, which has a hydrogen-producing cathode, the hydration of the membrane is obtained by keeping liquid water in contact with the cathode-side of the membrane, as will be explained below. For example, when using gas diffusion electrodes, liquid water is delivered to the cathode, and the liquid water passes through the gas-diffusion electrode and contacts the membrane. When using a catalyst-coated membrane, liquid water is delivered to the membrane itself, since the cathode is a thin layer of electrochemically active material applied directly to the membrane.

In particular, in the first embodiment, water is added to the electrochemical cell through cathode-side inlet 112. The protons (2H+ in eq. (1) above) which are produced by the oxidation of the anhydrous hydrogen halide are transported through the membrane and reduced at the cathode to form hydrogen gas, as given by equation (3) below.

$$2H^+ + 2e^- \xrightarrow[\text{Energy}]{\text{Electrical}} H_2(g) \tag{3}$$

This hydrogen gas is evolved at the interface between the cathode and the membrane and exits through the cathode-side outlet of the cell. This hydrogen gas may have a small amount of water vapor in it. The products which leave the cathode-side of the cell in the first embodiment are denoted by (I) in FIG. 1. In addition, the liquid water ($H_2O_{liquid}$) which has been introduced to the membrane through the cathode-side inlet exits through the cathode-side outlet as shown in FIG. 1. This water has some hydrogen chloride (HCl as shown in FIG. 1) dissolved in it, i.e., dilute HCl. The HCl is present because of the migration of the chloride ions through the membrane as noted above.

In the second embodiment, membrane hydration is accomplished by the production of water and by the water introduced in a humidified oxygen-feed or air-feed stream. In particular, in the second embodiment, an oxygen-containing gas, such as oxygen, air or oxygen-enriched air (i.e., greater than 21 mol % oxygen in nitrogen) is introduced through cathode-side inlet 112. Although air is cheaper to use, cell performance is enhanced when enriched air or oxygen is used. This oxygen-containing gas should be humidified to aid in the control of moisture in the membrane, for purposes to be explained below. The oxygen gas ($O_2$) and the transported protons are reduced at the cathode to water, as expressed by the equation:

$$\tfrac{1}{2}\, O_2(g) + 2e^- + 2H^+ \rightarrow H_2O(g) \tag{4}$$

The water formed (H2Ogas in equation (4)), which, as in the first embodiment, may have HCl formed therein due to chloride ion migration, exits via the cathode-side outlet, along with any unreacted oxygen gas ($O_{2gas}$), as denoted by (II) in FIG. 1.

In the second embodiment, the cathode reaction is the formation of water. This cathode reaction has the advantage of more favorable thermodynamics relative to $H_2$ production at the cathode in the first embodiment. This is because the overall reaction in this embodiment, which is expressed by the following equation:

$$2HCl\,(g) + 1/2O_2\,(g) \xrightarrow[\text{Energy}]{\text{Electrical}} H_2O\,(g) + Cl_2^- \tag{5}$$

involves a smaller free-energy change than the free-energy change for the overall reaction in the first embodiment, which is expressed by the following equation:

$$2HCl\,(g) \xrightarrow[\text{Energy}]{\text{Electrical}} H_2\,(g) + Cl_2^- \tag{6}$$

Thus, the amount of voltage or energy required as input to the cell is reduced in this second embodiment.

Returning again to the description of FIG. 2, the electrochemical cell of the present invention further comprises an anode flow field 116 disposed in contact with the anode and a cathode flow field 118 disposed in contact with the cathode as shown in FIGS. 2 and 2A. The flow fields are electrically conductive, and act as both mass and current flow fields. Preferably, the anode and the cathode flow fields comprise porous graphite paper. Such flow fields are commercially available from Spectracorp, of Lawrence, Mass. However, the flow fields may be made of any material and in any manner known to one skilled in the art. For example, the flow fields may alternatively be made of a porous carbon in the form of a foam, cloth or matte. For the purpose of acting as mass flow fields, the anode mass flow fields include a plurality of anode flow channels 120, and the cathode mass flow fields include a plurality of cathode flow channels 122 as shown in FIG. 2A, which is a cut-away, top cross-sectional view showing only the flow fields of FIG. 2. The anode flow fields and the anode flow channels get reactants, such as anhydrous hydrogen chloride (AHCl as shown in FIG. 1) in the first and second embodiments, to the anode and products, such as carbonyl chloride ($COCl_2$ as shown in FIG. 1), from the anode. The cathode flow field and the cathode flow channels get catholyte, such as liquid water ($H_2O_{liquid}$ as shown in FIG. 1) in the first embodiment to the membrane, or an oxygen-containing gas ($O_{2gas}$ as shown in FIG. 1) to the cathode in the second embodiment, and products, such as hydrogen gas ($H_{2gas}$ as shown in FIG. 1) in the first embodiment, or water ($H_2O_{gas}$ as shown in FIG. 1) in the second embodiment, from the cathode.

The electrochemical cell of the present invention may also comprise an anode-side gasket 124 and a cathode-side gasket 126 as shown in FIG. 2. Gaskets 124 and 126 form a seal between the interior and the exterior of the electrochemical cell. Preferably, the anode-side gas is made of a fluoroelastomer, sold under the trademark VITON® (hereinafter referred to as VITON®) by DuPont Dow Elastomers L.L.C. of Wilmington, Del. The cathode-side gasket may be made of the terpolymer ethylene/propylene/diene (EPDM), sold under the trademark NORDEL® by DuPont, or it may be made of VITON®.

The electrochemical cell of the present invention also comprises an anode current bus 128 and a cathode current bus 130 as shown in FIG. 2. The current buses conduct current to and from a voltage source (not shown). Specifically, anode current bus 128 is connected to the positive terminal of a voltage source, and cathode current bus 130 is connected to the negative terminal of the voltage source, so that when voltage is applied to the cell, current flows through all of the cell components to the right of current bus 128 as shown in FIG. 2, including current bus 130, from which it returns to the voltage source. The current buses are made of a conductor material, such as copper.

The electrochemical cell of the present invention may further comprise an anode current distributor 132 as shown in FIG. 2. The anode current distributor collects current from the anode current bus and distributes it to the anode by electronic conduction. The anode current distributor may comprise a fluoropolymer which has been loaded with a conductive material. In one embodiment, the anode current distributor may be made from polyvinylidene fluoride, sold under the trademark KYNAR® (hereinafter referred to as "KYNAR®") by Elf Atochem North America, Inc. Fluoropolymers, and graphite.

The electrochemical cell of the present invention may further comprise a cathode current distributor 134 as shown in FIG. 2. The cathode current distributor collects current from the cathode and for distributing current to the cathode bus by electronic conduction. The cathode distributor also provides a barrier between the cathode current bus and the cathode and the hydrogen halide. This is desirable because there is some migration of hydrogen halide through the membrane. Like the anode current distributor, the cathode current distributor may comprise a fluoropolymer, such as KYNAR®, which has been loaded with a conductive material, such as graphite.

The electrochemical cell of the present invention also includes an anode-side stainless steel backer plate (not shown), disposed on the outside of the cell next to the anode current distributor, and a cathodeside stainless steel backer plate (also not shown), disposed on the outside of the cell next to the cathode current distributor. These steel backer plates have bolts extending therethrough to hold the components of the electrochemical cell together and add mechanical stability thereto.

When more than one anode-cathode pair is used, such as in manufacturing, a bipolar arrangement, as familiar to one skilled in the art, is preferred. The electrochemical cell of the present invention may be used in a bipolar stack. To create such a bi-polar stack, anode current distributor 132 and every element to the right of the anode current distributor as shown in FIG. 2, up to and including cathode current distributor 134, are repeated along the length of the cell, and current buses are placed on the outside of the stack.

Returning again to the description of FIG. 1, the system for producing carbonyl halide further comprises an anode-side separator for separating the unreacted portions of the essentially anhydrous hydrogen halide and the carbon monoxide, respectively, from the carbonyl halide outside the electrochemical cell. Such a separator is shown at 16 in FIG. 1. Anode-side separator 16 is connected to electrochemical cell 100 through an exit line 23, which brings the unreacted portions of the essentially anhydrous hydrogen halide, such as hydrogen chloride, and the carbon monoxide, respectively, as well as the carbonyl halide, to the separator. The carbonyl halide, such as phosgene ($COCl_2$) exits the separator through a line 25.

The system of the present invention also comprises a recycle line for recycling the separated, unreacted anhydrous hydrogen halide and the separated, unreacted carbon monoxide to the inlet means of the electrochemical cell. A recycle line 18 is shown in FIG. 1. The hydrogen halide supply line and the carbon monoxide supply line are both connected to the recycle line outside the electrochemical cell. In particular, in FIG. 1, recycle line 18 is connected at one end to separator 16 for taking the unreacted anhydrous hydrogen chloride and carbon monoxide out of the separator, and to hydrogen halide supply line 12 and carbon monoxide supply line 14 at their juncture at line 15. With this arrangement, the hydrogen halide supply line mixes a fresh supply of hydrogen halide with the unreacted anhydrous hydrogen halide and the unreacted carbon monoxide and supplies this mixture to the cell. Similarly, the carbon monoxide supply line mixes a fresh supply of carbon monoxide with the unreacted anhydrous hydrogen halide and the unreacted carbon monoxide and supplies this mixture to the cell.

The system of the present invention also includes a cathode-side separator connected to the cathode-side outlet. This separator is shown at 20 in FIG. 1. Separator 20 is connected to a line 22 as shown in FIG. 1, which is connected to the cathode-side outlet. The products from and to the electrochemical cell, as well as to the separator, are denoted by (I) for the first embodiment, and by (II) for the second embodiment. In the first embodiment ((I) in FIG. 1), the separator separates the hydrogen gas ($H_{2gas}$) from the liquid water ($H_2O_{liquid}$ as shown in FIG. 1) which is added to the cathode-side inlet, and which has some hydrogen halide, such as HCl, dissolved therein, i.e., dilute HCl. The hydrogen gas ($H_{2gas}$), which has a small amount of water vapor in it ($H_2O_{vapor}$) exits the separator through a line 27 as shown in FIG. 1. In the second embodiment, where an oxygen-containing gas, such as oxygen ($O_{2gas}$ in FIG. 1), is added to the cathode-side inlet, a portion of the oxygen gas may be unreacted, and separator 20 separates this unreacted oxygen gas ($O_{2gas}$ in FIG. 1), along with water vapor having some hydrogen halide, such as HCl, dissolved therein ($H_2O_{vapor}/HCl_{vapor}$ in FIG. 1), from the water ($H_2O_{gas}$ in FIG. 1) formed at the cathode. The water ($H_2O_{gas}$), which also may have a small amount of hydrogen halide, such as HCl dissolved therein, exits the separator through line 27.

The system of the present invention also includes a recycle line disposed between the cathode-side separator and the cathode-side inlet. This recycle line is shown at 24 in FIG. 1. In the first embodiment ((I) in FIG. 1), this recycle line recycles the liquid water ($H_2O_{liquid}$ as shown in FIG. 1) which is added to the cathode-side of the membrane, and which has some hydrogen halide, such as HCl as shown in FIG. 1, dissolved therein, back to the cathode-side inlet. In the second embodiment ((II) in FIG. 1), this recycle line recycles the unreacted oxygen ($O_2$), as well as water vapor ($H_2O_{vapor}$) and hydrogen halide vapor, such as $HCl_{vapor}$ as shown in FIG. 1, back to the cathode-side inlet.

Further in accordance with the present invention, there is provided a process for producing carbonyl halide. The operation of the electrochemical cell and system of the present invention as described above will now be described as they relate to an illustrated case of the process of the present invention, where the essentially anhydrous hydrogen halide is hydrogen chloride, and phosgene is produced from chlorine produced during the electrochemical conversion of the essentially anhydrous hydrogen chloride. However, the process of the present invention is also applicable to all hydrogen halides, including, but not limited to, hydrogen fluoride.

In operation, anhydrous hydrogen halide, such as anhydrous hydrogen chloride, which is in molecular form, is supplied to the inlet means of an electrochemical cell, such as anode-side inlet 102 of electrochemical cell 100, and then to the anode compartment of the cell, such as compartment 103, through a supply line, such as line 12. Carbon monoxide is supplied to the inlet means of the electrochemical cell, and then to the anode compartment of the cell through a supply line, such as supply line 14. As explained above, the carbon monoxide is added in stoichiometric excess of the hydrogen halide, such as hydrogen chloride, so as to keep the free halogen content of the carbonyl halide, such as carbonyl chloride, as low as possible.

A voltage is applied to the electrochemical cell such that the anode is at a higher potential than the cathode. Current flows to the anode bus of the cell, such as bus 128 as shown in FIG. 2. Molecules of essentially anhydrous hydrogen halide, which is a gas, such as hydrogen chloride gas, flow through channels in the anode mass flow field, such as channels 120 formed in flow field 116, and are transported to the surface of the anode. The anhydrous hydrogen halide is oxidized at the anode under the potential created by the voltage source to produce essentially dry halogen, such as chlorine $Cl_2$, at the anode, and protons ($H^+$). This reaction is given by the equation (1) above. The halogen, such as chlorine, react with the carbon monoxide in the anode compartment of the cell to form carbonyl halide, such as carbonyl chloride, or phosgene. This reaction is given by the equation (2) above. The carbonyl chloride, such as phosgene, exits through an anode-side outlet, such as outlet 106 as shown in FIG. 2, and then through an exit line, such as line 23 as shown in FIG. 1.

The protons are transported through a membrane of the electrochemical cell, such as membrane 108 as shown in FIGS. 2 and 2A. In the first embodiment, water, ($H_2O_{liquid}$ in FIG. 1) is delivered to a cathode-side inlet, such as inlet 112 as shown in FIG. 2, to a cathode compartment, such as cathode compartment 105 as shown in FIGS. 2 and 2A, and through the channels in cathode mass flow field, such as channels 122 as shown in FIG. 2A, to the cathode-side of the membrane to hydrate the membrane, thereby increasing the efficiency of proton transport through the membrane. The transported protons are reduced at the cathode to form hydrogen gas, which may have a small amount of water vapor in it. The hydrogen gas bubbles through the water which is delivered to the membrane and exits via a cathode-side outlet, such as outlet 114. Dilute hydrogen halide, formed by the migration of halide ions, such as chloride ions, through the membrane and by the water delivered to the membrane, also exits through the cathode-side outlet. In the second embodiment, an oxygen-containing gas, such as oxygen gas, is introduced to the cathode through a cathode-side inlet, such as inlet 112 as shown in FIG. 2, and through the channels in cathode mass flow field, such as channels 118 as shown in FIG. 2A. The oxygen gas and the transported protons are reduced at the cathode to water, as expressed by equation (4) above. The water may have some hydrogen halide dissolved in it (i.e., dilute hydrogen halide), again because of the migration of halide ions through the membrane. The water, including the dilute hydrogen halide, exits via the cathode-side outlet, along with any unreacted oxygen gas. A cathode current distributor, such as distributor 134 as shown in FIG. 2 collects current from the cathode and distributes it to a cathode bus, such as cathode current bus 130 as shown in FIG. 2.

In either the first or the second embodiment, a portion of the anhydrous hydrogen halide and a portion of the carbon monoxide may be unreacted. These unreacted portions exit the cell through an anode-side outlet, such as outlet 106 as shown in FIG. 2. As noted above, carbonyl halide produced in the cell also exits the cell through the anode-side outlet. Thus, in accordance with the process of the present invention, the carbonyl halide is separated from the unreacted anhydrous hydrogen halide and the unreacted carbon monoxide by an anode-side separator, such as anode-side separator 16 as shown in FIG. 1. The unreacted anhydrous hydrogen halide and the carbon monoxide may be recycled to the anode-side inlet of the electrochemical cell through a recycle line, such as recycle line 18, which joins with line 15 as shown in FIG. 1.

The unreacted anhydrous hydrogen halide and the unreacted carbon monoxide may be mixed with a fresh supply of anhydrous hydrogen halide, which is supplied through a supply line, such as line 12 in FIG. 1. In addition, the unreacted anhydrous hydrogen halide and carbon monoxide may be mixed with a fresh supply of carbon monoxide through a supply line, such as line 14 as shown in FIG. 1. The mixture of the unreacted anhydrous hydrogen halide and the unreacted carbon monoxide, and of the fresh anhydrous hydrogen halide and the fresh carbon monoxide is fed through a line, such as line 15 in FIG. 1, to the anode-side inlet of the electrochemical cell.

In the first embodiment of the process of the present invention, the water added to the cathode-side of the membrane, the hydrogen gas produced and dilute hydrogen halide from the migration of halide ions through the membrane, are released through the cathode-side outlet of the cell, such as outlet 114 as shown in FIG. 2, as noted above, and are sent through a line, such as 22 in FIG. 1. The hydrogen gas, which has some water vapor in it, is separated from the water and the dilute hydrogen halide by a separator, such as cathode-side separator 20 as shown in FIG. 1. The hydrogen gas and the water vapor therein exit the separator through an exit line, such as line 27 as shown in FIG. 1. The water and the dilute hydrogen halide are recycled back to the cathode-side inlet, such as inlet 112 as shown in FIGS. 1 and 2, through a recycle line, such as line 24 as shown in FIG. 1. In the second embodiment, an oxygen-containing gas, such as oxygen gas, is delivered to the cathode-side inlet of the cell, such as inlet 112 in FIG. 2. The oxygen gas and the protons, which are transported through the membrane are reduced to form water, which hydrates the membrane. The water may have some hydrogen halide, such as HCl, dissolved therein. The oxygen gas and the water exit the cell through cathode-side outlet, such as outlet 114, as noted above, into a line, such as line 22 as shown in FIG. 1. A portion of the oxygen-containing gas may be unreacted. This unreacted oxygen-containing gas also exits the cell through the cathode-side outlet and through a line, such as line 22, along with the water formed at the cathode and the dilute hydrogen halide from the migration of halide ions through the membrane. The unreacted oxygen gas, as well as hydrogen halide and water, both in the form of vapor, are separated from the water formed at the cathode, which may have some hydrogen halide dissolved therein, by a cathode-side separator, such as separator 20 as shown in FIG. 1. The water and the dissolved hydrogen halide exit the separator through a line, such as line 27 as shown in FIG. 1. The unreacted oxygen gas, the hydrogen halide vapor and the water vapor may be recycled back to the cathode-side inlet, such as inlet 112 as shown in FIG. 1, through a line, such as line 24 as shown in FIG. 1.

Additional advantages and modifications will readily occur to those skilled in the art. The invention, in its broader aspects, is therefore not limited to the specific details and representative apparatus shown and described. Accordingly, departures may be made from such details without departing from the spirit or scope of the general inventive concept as defined by the appended claims and their equivalents.

What is claimed is:

1. An electrochemical cell for producing carbonyl halide, comprising:

(a) inlet means for introducing anhydrous hydrogen halide and carbon monoxide to an anode compartment;

(b) means for oxidizing the anhydrous hydrogen halide to produce halogen and protons, wherein the halogen and the carbon monoxide react in the anode compartment to form carbonyl halide;

(c) outlet means for releasing the carbonyl halide from the anode compartment;

(d) cation-transporting means for transporting the protons therethrough, wherein the oxidizing means is disposed in contact with one side of the cation-transporting means; and (e) means for reducing the transported protons, wherein the reducing means is disposed in contact with the other side of the cation-transporting means.

2. A system for producing carbonyl halide, comprising:

(a) an electrochemical cell, including:

(i) inlet means for introducing anhydrous hydrogen halide and carbon monoxide to an anode compartment, (ii) means for oxidizing the anhydrous hydrogen halide to produce halogen and protons, wherein the halogen and the carbon monoxide react in the anode compartment to form carbonyl halide and further wherein a portion of the carbon monoxide and a portion of the anhydrous hydrogen halide are unreacted, (iii) outlet means for releasing the carbonyl halide and the unreacted carbon monoxide and the unreacted anhydrous hydrogen halide from the anode compartment, (iv) cation-transporting means for transporting the protons therethrough, wherein one side of the oxidizing means is disposed in contact with one side of the cation-transporting means, and (v) means for reducing the transported protons, wherein the reducing means is disposed in contact with the other side of the cation-transporting means;

(b) an anode-side separator for separating the unreacted portions of the anhydrous hydrogen halide and the carbon monoxide from the carbonyl halide; and (c) a recycle line for recycling the separated, unreacted hydrogen halide and the separated, unreacted carbon monoxide to the inlet means of the electrochemical cell.

3. The system of claim 2, wherein the oxidizing means is an anode, the reducing means is a cathode and the cation-transporting means is a membrane.

4. The system of claim 3, further including a hydrogen halide supply line connected to the inlet means for supplying the anhydrous hydrogen halide to the cell.

5. The system of claim 4, further including a carbon monoxide supply line connected to the inlet means for supplying carbon monoxide to the cell.

6. The system of claim 5, wherein the hydrogen halide supply line is connected to the recycle line outside the cell.

7. The system of claim 6, wherein the carbon monoxide supply line is connected to the recycle line outside the cell.

8. The system of claim 3, wherein a cathode compartment is disposed on the other side of the cathode and a cathode-side inlet and a cathode-side outlet are both disposed in fluid communication with the cathode compartment, further including a cathode-side separator connected to the cathode-side outlet.

9. The system of claim 8, further including a recycle line disposed between the cathode-side separator and the cathode-side inlet.

10. A process for producing carbonyl halide, comprising the steps of:

(a) supplying carbon monoxide and anhydrous hydrogen halide to an anode-side inlet of an electrochemical cell, wherein the electrochemical cell also comprises a cation-transporting membrane, an anode disposed in contact with one side of the membrane and a cathode disposed in contact with another side of the cation-transporting membrane, wherein the carbon monoxide is supplied in stoichiometric excess of the anhydrous hydrogen halide; and (b) applying a voltage to the electrochemical cell such that the anode is at a higher potential than the cathode, and such that:

(i) the anhydrous hydrogen halide is oxidized at the anode to produce halogen and protons, (ii) the halogen reacts with the carbon monoxide to form carbonyl halide, (iii) the carbonyl halide is released from an anode-side outlet of the cell, (iv) the protons are transported through the cation-transporting membrane of the cell, and (v) the transported protons are reduced at the cathode of the cell.

11. The process of claim 10, wherein a portion of the anhydrous hydrogen halide is unreacted and a portion of the carbon monoxide is unreacted, and the carbonyl halide is separated from the unreacted anhydrous hydrogen halide and the unreacted carbon monoxide.

12. The process of claim 11, wherein the unreacted anhydrous hydrogen halide and the unreacted carbon monoxide are recycled to the anode-side inlet of the electrochemical cell.

13. The process of claim 12, further including the step of delivering water through a cathode-side inlet to the cathode-side of the membrane for hydrating the membrane.

14. The process of claim 13, wherein the transported protons are reduced to form hydrogen gas, the hydrogen gas is separated from the water in a cathode-side separator, and the water is recycled to the cathode-side inlet.

15. The process of claim 12, further including the step of delivering an oxygen-containing gas through a cathode-side inlet to the cathode, wherein the oxygen-containing gas and the protons are reduced to form water for hydrating the membrane.

16. The process of claim 15, wherein a portion of the oxygen-containing gas is unreacted, the unreacted oxygen-containing gas is separated from the water in a cathode-side separator, and the unreacted oxygen-containing gas is recycled to the cathode-side inlet.

17. The process of claim 10, wherein the unreacted hydrogen halide and the unreacted carbon monoxide are mixed with a supply of fresh anhydrous hydrogen halide and a fresh supply of carbon monoxide.

18. The process of claim 17, wherein the mixture of the unreacted hydrogen halide, the unreacted carbon monoxide, the fresh hydrogen halide and the fresh carbon monoxide is fed to the anode-side inlet of the cell.

19. The process of claim 10, wherein the carbonyl halide is carbonyl chloride.

20. The process of claim 10, wherein the carbonyl halide is carbonyl fluoride.

* * * * *

UNITED STATES PATENT AND TRADEMARK OFFICE

CERTIFICATE OF CORRECTION

PATENT NO. : 5,891,319

DATED : April 6, 1999

INVENTOR(S) : Freire et al.

It is certified that error appears in the above-identified patent and that said Letters Patent is hereby corrected as shown below:

Title should read "Method and Apparatus for Production of Carbonyl Halide.

Column 2, line 14, in place of "chloride anions" should appear --chlorine--.

Column 4, line 41, "carbonyl" should be --hydrogen--.

Column 5, line 25, insert a space between "alkyl" and "vinyl".

Column 9, line 18, "5:1" should be ".5:1".

Column 10, line 63, "H2O" should be "$H_2O$".

Signed and Sealed this

Fourteenth Day of March, 2000

*Attest:*

Q. TODD DICKINSON

*Attesting Officer*

*Commissioner of Patents and Trademarks*